United States Patent [19]

Tombari

[11] 4,187,557

[45] Feb. 12, 1980

[54] ATHLETIC GLOVE

[76] Inventor: Aldo L. Tombari, 2872 Valleyview Dr., Huntington, Ind. 46750

[21] Appl. No.: 895,269

[22] Filed: Apr. 10, 1978

[51] Int. Cl.[2] ..... A41D 19/00; A63B 71/14

[52] U.S. Cl. ..... 2/19; 273/26 C

[58] Field of Search ..... 2/19, 20, 159, 161 A, 2/161 R; 273/25, 26 C, 81 D, 814, 188 R

[56] References Cited

U.S. PATENT DOCUMENTS

| | | | |
|---|---|---|---|
| 325,968 | 9/1885 | Rawlings | 2/159 X |
| 1,509,801 | 9/1924 | Walters | 2/19 |
| 1,612,822 | 1/1927 | Jones | 2/161 R |
| 2,083,935 | 6/1937 | Arnold | 2/159 X |

FOREIGN PATENT DOCUMENTS

| | | | |
|---|---|---|---|
| 2536180 | 2/1977 | Fed. Rep. of Germany | 2/161 A |
| 547946 | 9/1942 | United Kingdom | 2/159 |

*Primary Examiner*—Werner H. Schroeder

*Attorney, Agent, or Firm*—Bell, Seltzer, Park & Gibson

[57] ABSTRACT

An athletic glove for baseball players, and which includes a pad overlying the second phalange of each of the third and fourth fingers, to thereby increase the force which these fingers are able to apply to the bat. In use, the third and fourth fingers on the glove hand, and the first and second fingers on the other hand, form hinged control points at the extremities of the two hands, thereby improving the leverage which is imparted to the bat, and facilitating the directional control and increasing the velocity of the bat.

10 Claims, 5 Drawing Figures

ATHLETIC GLOVE

The present invention relates to an athletic glove which is particularly adapted for use by baseball batters to facilitate the gripping and swinging of a bat.

It is recognized that the index (or first) and second fingers of the hand are stronger than the third and fourth fingers, and thus the first two fingers normally grip a bat, or the like with a stronger force than is achieved with the remaining two fingers. Thus, for example, when a baseball bat is tightly gripped, the first two fingers of each hand usually form a pair of spaced apart, tight securement points which function as hinge points when the bat is swung. These hinge points are spaced apart a relatively short distance, corresponding generally to the width of one hand. During the swing of the bat, various other parts of the hands may come into play, resulting in an interference with the swinging motion and thereby limiting control and velocity.

In accordance with the present invention, it has been found that by extending the distance between the above described hinge points, and more particularly, by locating and fixing the hinge points at the extremities of the two hands, substantially improved control of the directional movement, and substantially increased velocity can be obtained. In this regard, it has been found that the gripping force of the third and fourth fingers may be substantially increased by positioning a pad under the second phalange of each such finger. When the gripping force is increased by this arrangement, the hinge point is effectively moved from the area beneath the first and second fingers to the area beneath the third and fourth fingers. Thus, for a right-handed person, the pads would be positioned beneath the third and fourth fingers of the left hand, and such that the two hinge points are located beneath the first two fingers of the right hand and the third and fourth fingers of the left hand. The separation of the hinge points is thereby increased by perhaps about two inches, and this wider separation has been found to improve the leverage imparted to the bat by the hands, and thereby permit more effective control of the swing, and a higher velocity swing. In addition, the hinge points are effectively fixed at the extremities of the hands, thereby minimizing interference from other parts of the hands during the swing of the bat.

It is accordingly an object of the present invention to provide an athletic glove to be used by baseball batters, and which is characterized by the ability to improve the directional control and swing velocity of the bat.

It is also an object of the present invention to provide an athletic glove which incorporates a novel and uncomplicated structure whereby the gripping force of the third and fourth fingers may be increased, and without interfering with the normal, independent movement of each finger.

It is a more specific object of the present invention to provide an athletic glove adapted for use by baseball batters, and which serves to locate and fix the hinge points at the extremities of the two hands to thereby improve the leverage imparted to the bat by the hands, and alleviate interference from other parts of the hands during the swing of the bat.

These and other objects and advantages of the present invention are achieved in the embodiment illustrated herein by the provision of an athletic glove which comprises a body portion which is adapted to overlie the palm of the hand, and which includes means for releasably retaining the same on the wearer's hand. Two tubular finger portions are attached to the body portion, and are adapted to respectively receive the third and fourth fingers of the wearer's hand. A pad is mounted to each of the two finger portions and is preferably positioned to overlie the inside of the second phalange of the respective finger, and the pads each have a thickness sufficient to enable the third and fourth fingers to significantly increase their gripping force on a bat, to thereby improve directional control and increase swing velocity.

Some of the objects having been stated, other objects will appear as the description proceeds, when taken in connection with the accompanying drawings in which FIG. 1 is a perspective view of an athletic glove embodying the present invention and positioned on a wearer's hand;

Figure 1:
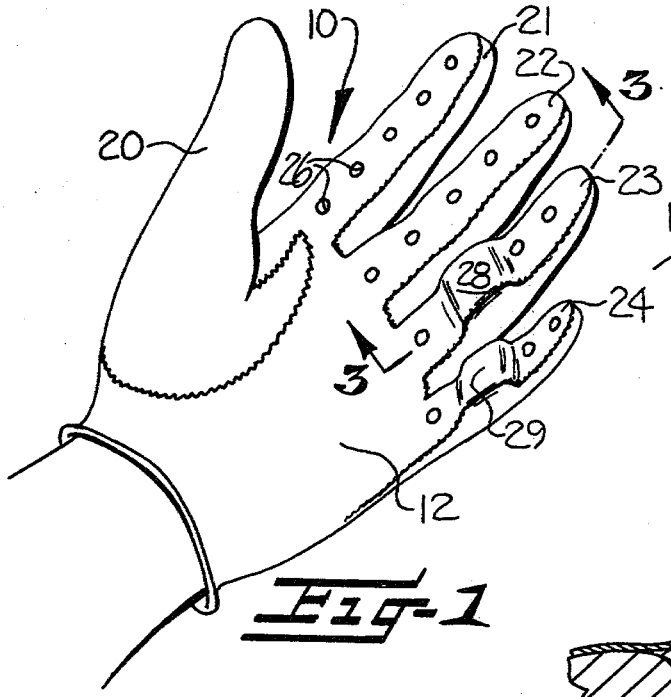
Figure 2:
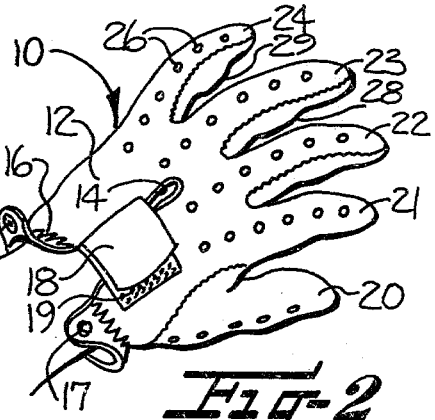
FIG. 2 is a perspective view of the back of the glove.

Referring more specifically to the drawings, an athletic glove which embodies the features of the present invention is illustrated generally at 10. The glove is fabricated from a fabric or leather of the type commonly employed in present athletic gloves, and includes a tubular body portion 12 which is adapted to receive the palm portion of the wearer's hand, and so as to overlie and cover substantially the full area of the palm as well as the back of the hand. The back side of the body portion includes a V-shaped notch 14 to facilitate entry of the hand, and means for releasably retaining the glove on the wearer's hand. As illustrated, this retaining means comprises an elastic band 16 at the lower end of the body portion so as to encircle the wrist of the wearer, and a snap fastener 17. Also, there is provided a flap 18 extending across the notch 14 and a mating Velcrotype fastening tab 19 for tightly securing the body portion about the hand.

A tubular thumb receiving portion 20 is attached to the body portion in the conventional manner, and in addition, four separate tubular finger portions 21, 22, 23, and 24 are also attached to the body portion for respectively receiving the four fingers of the wearer's hand. In the illustrated embodiment, each of the thumb portion 20 and four finger portions 21–24 have a length sufficient to fully enclose the respective thumb or finger, and the remote ends are closed. It will be understood, however, that these portions may have a shorter length and open ends, such that the thumb and fingers extend through and beyond these portions. Also, as illustrated, the four finger portions each have a series of openings 26 on both the inside and outside surfaces thereto to facilitate ventilation.

Figure 3:
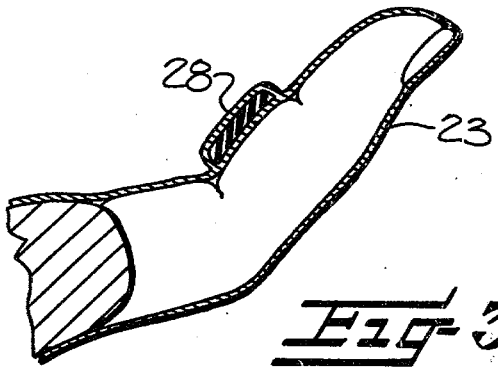
FIG. 3 is a sectional view taken through the third finger of the wearer's hand and substantially along the line 3—3 of FIG. 1.

A pad is mounted to each of the two finger portions which are adapted to receive the third and fourth fingers, with the pads being sized and positioned to overlie the inside of only the second phalange of the respective finger. More particularly, a pad 28 is positioned on the inside of the finger portion 23 and a pad 29 is positioned on the inside of the finger portion 24. The pads may be fabricated from a hard rubber or similar material, and are secured in the indicated position by a closed pocket formed in the material of the glove, note FIG. 3. Typically, the pads have a thickness of between about $\frac{1}{8}$ to $\frac{1}{4}$ inch, and the pad 29 associated with the fourth finger is somewhat thicker than the pad 28 associated with the third finger for the purposes to become apparent. Viewing FIG. 1, it will be observed that the first and second finger portions 21, 22 have a generally uniform thickness throughout their length and are free of any pad.

Figure 4:
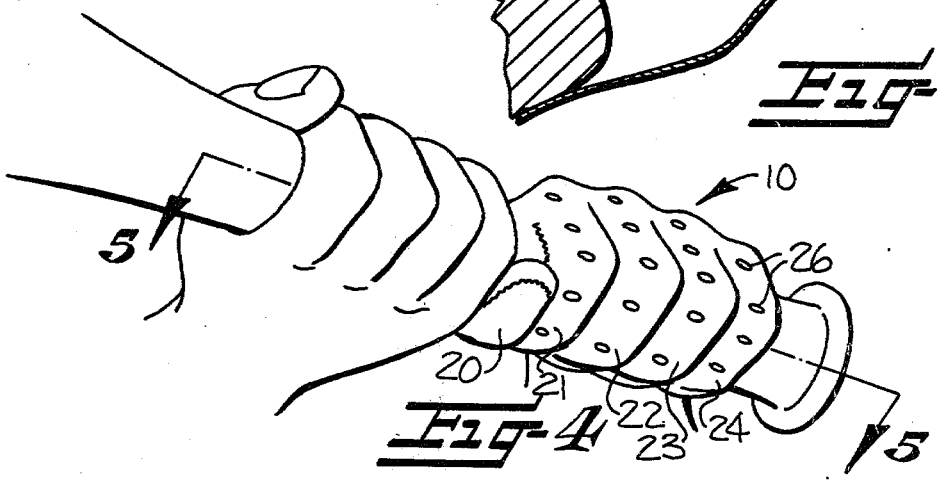
FIG. 4 is a perspective view of the wearer's hands gripping a baseball bat, with the glove positioned on the left hand.
Figure 5:
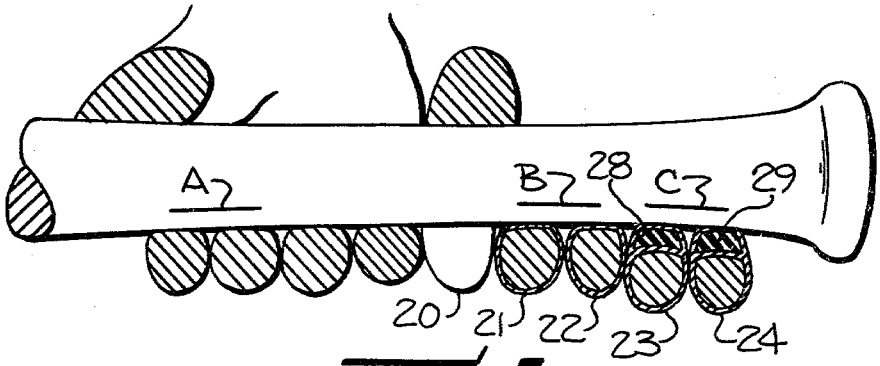
FIG. 5 is a sectional view taken substantially along the line 5—5 of FIG. 4.

In accordance with the present invention, it has been discovered that the presence of the pads 28, 29 beneath the second phalange of the third and fourth fingers acts to increase the potential gripping force which these fingers are able to apply to the bat, and such that these fingers may readily grip the bat with more strength than do the first two fingers. Thus the hinge points as described above may be effectively moved from a point beneath the first two fingers and fixed at a point beneath the third and fourth fingers. For example, in the case of a right-handed person gripping a bat as shown in FIGS. 4 and 5 but without the glove of the present invention, the hinge points are normally located at points A and B. When the glove 10 is positioned on the batter's left hand, the left hand hinge point may be moved to the point C. Thus the separation of the two hinge points is effectively increased by about two inches, and it has been found that this increase materially improves the leverage with which the hands are able to apply to the bat. In addition, the fixation of the hinge points at the extremities of the hands acts to effectively alleviate interference from other parts of the hands during the swing of the bat. These advantages in turn result in improved directional control of the bat, and a greater swing velocity. It is also important to note that with the present invention, the third and fourth fingers are free of any restraint imposed by the presence of the pads, and there is no interference with the normal, independent movement of each finger which is necessary for a proper grip on the bat.

In the drawings and specification, there has been set forth a preferred embodiment of the invention, and although specific terms are employed, they are used in a generic and descriptive sense only and not for purposes of limitation. While the present invention has been described as being primarily useful by baseball batters, it will be understood that the glove of the present invention is also useful in other sports where a bat or club is gripped, such as golf.

That which is claimed is:

1. An athletic glove adapted to be used by baseball batters or the like, and characterized by the ability to improve the leverage imparted to the bat by the hands, to thereby improve directional control and obtain greater swing velocity, and comprising a body portion adapted to overlie at least a portion of the palm of a wearer's hand, at least two tubular finger portions attached to said body portion and adapted to respectively receive the third and fourth fingers of the wearer's hand, and having a length sufficient to overlie the second phalange of each such finger, and a single pad mounted to the inside of each of said two finger portions, with each of said pads positioned to overlie only the second phalange of the respective fingers and with the remainder of said finger portions being free of any pad, said pads each having a thickness sufficient to enable the third and fourth fingers to significantly increase the force which they are able to apply to a bat.

2. The athletic glove as defined in claim 1 wherein said body portion further includes means for releasably retaining the same on the wearer's hand.

3. The athletic glove as defined in claim 2 wherein said pads have a thickness between about $\frac{1}{8}$ to $\frac{1}{4}$ inch.

4. An athletic glove adapted for use by baseball batters and the like, and characterized by the ability to improve the leverage imparted to the bat by the hands, to thereby improve directional control and obtain greater swing velocity, and comprising a body portion adapted to overlie the palm of the wearer's hand and including means encircling the wearer's wrist for releasably retaining the body portion on the hand, four tubular finger portions attached to the body portion and adapted to respectively receive the four fingers of the wearer's hand, at least said finger portions which are adapted to receive the third and fourth fingers having a length sufficient to overlie the second phalange of the respective third and fourth fingers, and a pad mounted to each of said two finger portions which are adapted to receive the third and fourth fingers, with said pads being positioned to overlie the inside of at least the second phalange of the respective finger, said pads each having a thickness sufficient to enable the third and fourth fingers to significantly increase the force which they are able to apply to a bat, and wherein the two finger portions which are adapted to receive the first and second fingers of the wearer's hand have a generally uniform thickness throughout their length and are free of any pads.

5. The athletic glove as defined in claim 4 wherein said pads are sized to overlie only the second phalange of the respective finger.

6. The athletic glove as defined in claim 5 wherein the pad associated with said fourth finger is somewhat thicker than the pad associated with said third finger.

7. The athletic glove as defined in claim 6 wherein said body portion is tubular and is adapted to overlie substantially the full area of the palm and back of the wearer's hand.

8. The athletic glove as defined in claim 7 further comprising a tubular thumb portion which is adapted to receive the thumb of the wearer's hand.

9. The athletic glove as defined in claim 8 wherein said means for releasably retaining the body portion includes an elastic band adapted to surround the wrist of the wearer.

10. The athletic glove as defined in claim 9 wherein said finger and thumb portions each have a length sufficient to receive the full extent of the respective fingers and thumb of the wearer's hand.

* * * * *